US011380476B2

(12) United States Patent
Sato et al.

(10) Patent No.: US 11,380,476 B2
(45) Date of Patent: Jul. 5, 2022

(54) MULTILAYER COIL COMPONENT

(71) Applicant: TDK CORPORATION, Tokyo (JP)

(72) Inventors: Takahiro Sato, Tokyo (JP); Hitoshi Kudo, Tokyo (JP); Takashi Suzuki, Tokyo (JP); Kouichi Kakuda, Tokyo (JP); Tatsuro Suzuki, Tokyo (JP); Hiroyuki Tanoue, Tokyo (JP)

(73) Assignee: TDK CORPORATION, Tokyo (JP)

( * ) Notice: Subject to any disclaimer, the term of this patent is extended or adjusted under 35 U.S.C. 154(b) by 867 days.

(21) Appl. No.: 16/227,112

(22) Filed: Dec. 20, 2018

(65) Prior Publication Data

US 2019/0198232 A1 Jun. 27, 2019

(30) Foreign Application Priority Data

Dec. 26, 2017 (JP) ..... JP2017-248867

(51) Int. Cl.

| | |
|---|---|
| ***H01F 27/29*** | (2006.01) |
| ***H01F 27/28*** | (2006.01) |
| ***H01F 17/00*** | (2006.01) |
| *H01F 41/04* | (2006.01) |
| *H01F 1/34* | (2006.01) |

(52) U.S. Cl.

CPC ..... *H01F 27/292* (2013.01); *H01F 17/0013* (2013.01); *H01F 27/2804* (2013.01); *H01F 1/344* (2013.01); *H01F 41/041* (2013.01); *H01F 2027/2809* (2013.01)

(58) Field of Classification Search

CPC ..... H01F 27/292; H01F 17/0013; H01F 27/2804; H01F 1/344; H01F 41/041; H01F 2027/2809; H01F 2017/002; H01F 17/04; H01F 27/24; H01F 27/306

See application file for complete search history.

(56) References Cited

U.S. PATENT DOCUMENTS

| | | | | |
|---|---|---|---|---|
| 10,290,415 | B2 * | 5/2019 | Koizumi | H01F 17/045 |
| 2005/0018382 | A1 | 1/2005 | Takazawa | |

(Continued)

FOREIGN PATENT DOCUMENTS

| | | | |
|---|---|---|---|
| CN | 107437458 | A | 12/2017 |
| JP | 2005-038904 | A | 2/2005 |

(Continued)

*Primary Examiner* — Tuyen T Nguyen
(74) *Attorney, Agent, or Firm* — Oliff PLC

(57) ABSTRACT

In a multilayer coil component, a ferrite element body includes a first element body portion and a second element body portion adjacent to each other in an axial direction of the multilayer coil, in which a dielectric constant of the second element body portion is lower than a dielectric constant of the first element body portion, and a magnetic permeability of the second element body portion is higher than a magnetic permeability of the first element body portion. The inventors newly found that the first element body portion and the second element body portion contribute to coil characteristics when a coil winding portion is provided to extend over the first element body portion and the second element body portion. In the multilayer coil component, desired coil characteristics can be obtained by adjusting proportions of the first element body portion and the second element body portion in the ferrite element body.

6 Claims, 3 Drawing Sheets

(56) References Cited

U.S. PATENT DOCUMENTS

| | | | | |
|---|---|---|---|---|
| 2016/0055955 | A1* | 2/2016 | Park | H01F 27/255<br>336/83 |
| 2017/0345552 | A1 | 11/2017 | Nakano et al. | |

FOREIGN PATENT DOCUMENTS

| | | | |
|---|---|---|---|
| JP | 2007-243798 | A | 9/2007 |
| JP | 2008-079020 | A | 4/2008 |
| JP | 2017-212372 | A | 11/2017 |

* cited by examiner

MULTILAYER COIL COMPONENT

CROSS-REFERENCE TO RELATED APPLICATIONS

This application is based upon and claims the benefit of priority from Japanese Patent Application No. 2017-248867, filed on 26 Dec. 2017, the entire contents of which are incorporated herein by reference.

TECHNICAL FIELD

The disclosure relates to a multilayer coil component.

BACKGROUND

Conventionally, a multilayer coil component having a multilayer coil provided in a ferrite element body is known. For example, a multilayer coil component having a ceramic element body in a three-layered structure (a so-called sandwich structure) in which an inner layer portion having relatively high porosity is sandwiched by a pair of outer layer portions having relatively low porosity is disclosed in Japanese Unexamined Patent Publication No. 2005-38904 (Patent Document 1). In such a multilayer coil component, it is known that a dielectric constant and a magnetic permeability increase when the porosity of the element body is low, and a dielectric constant and a magnetic permeability decrease when the porosity of the element body is high.

SUMMARY

After intensive research, the inventors have newly found a technology in which coil characteristics such as impedance, inductance, and self-resonant frequency (SRF) can be adjusted in a multilayer coil component constituted by multi-layered element bodies.

According to the disclosure, a multilayer coil component in which coil characteristics can be adjusted is provided.

A multilayer coil component according to one aspect of the disclosure is a multilayer coil component having a multilayer coil provided in a ferrite element body, and external electrodes respectively provided on end surfaces of the ferrite element body facing each other, in which the ferrite element body includes a first element body portion and a second element body portion adjacent to each other in an axial direction of the multilayer coil, in which a dielectric constant of the second element body portion is lower than a dielectric constant of the first element body portion, and a magnetic permeability of the second element body portion is higher than a magnetic permeability of the first element body portion, and the multilayer coil includes a winding portion and a lead-out portion, the lead-out portion extends from end portions of the winding portion to the end surfaces provided with the external electrodes thereon, in which the winding portion extends over the first element body portion and the second element body portion.

In a configuration in which a winding portion of the multilayer coil is provided only in the inner layer portion and a lead-out portion thereof is provided only in the outer layer portion as in Patent Document 1 described above, it is extremely difficult to adjust coil characteristics. After intensive research, the inventors newly found that a first element body portion and a second element body portion contribute to coil characteristics as follows when a winding portion is provided to extend over the first element body portion and the second element body portion. That is, regarding an impedance around 1 GHz, the first element body portion has a relatively high impedance and the second element body portion has a relatively low impedance. Also, regarding inductance, the first element body portion has a relatively low inductance and the second element body portion has a relatively high inductance. Further, regarding a self-resonant frequency, the first element body portion has a relatively high self-resonant frequency and the second element body portion has a relatively low self-resonant frequency. Therefore, in the above-described multilayer coil component, desired coil characteristics can be obtained by adjusting proportions of the first element body portion and the second element body portion in the ferrite element body.

In a multilayer coil component according to another aspect, an axial direction of the multilayer coil may be parallel to a direction wherein the end surfaces face each other, the end surfaces being provided with the external electrodes.

In a multilayer coil component according to another aspect, the ferrite element body may have a structure in which one of the first element body portions and the second element body portions sandwich the other thereof in the axial direction of the multilayer coil.

In a multilayer coil component according to another aspect, the ferrite element body may include a pair of second element body portions and have a structure in which the first element body portion is sandwiched by the pair of second element body portions in the axial direction of the multilayer coil. In this case, when external electrodes are provided on the second element body portions having a relatively low dielectric constant, high frequency characteristics of the multilayer coil component are improved.

DETAILED DESCRIPTION

Hereinafter, an embodiment of the disclosure will be described with reference to the accompanying drawings. In the description of the drawings, the same elements or elements having the same functions will be denoted by the same reference signs and duplicate descriptions thereof will be omitted.

Figure 1:
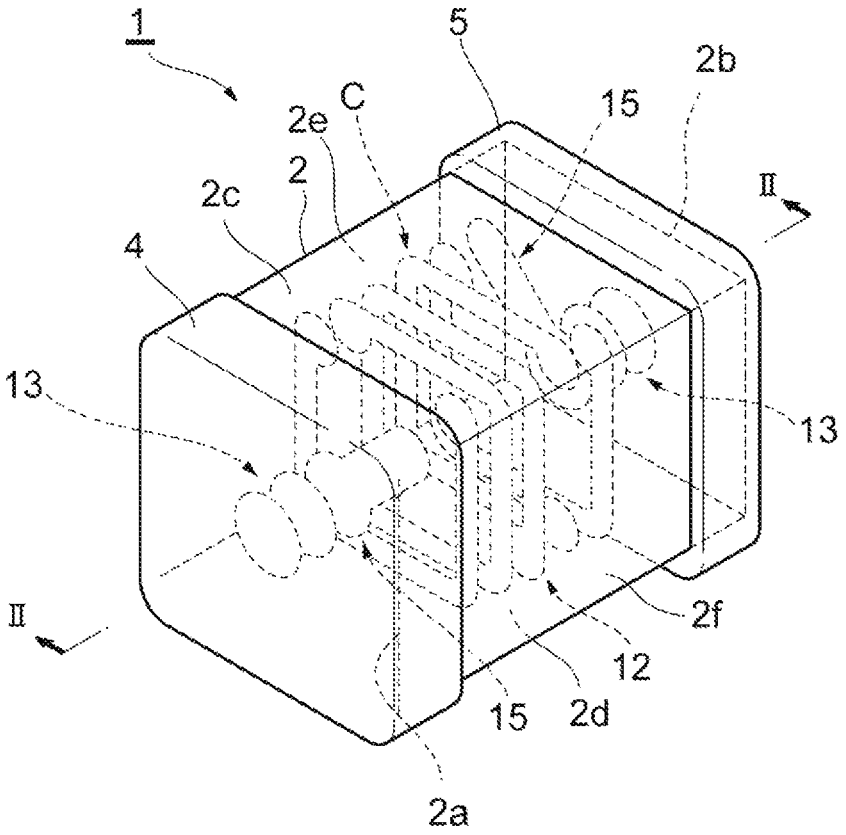
FIG. 1 is a perspective view illustrating a multilayer coil component according to one embodiment.
Figure 2:
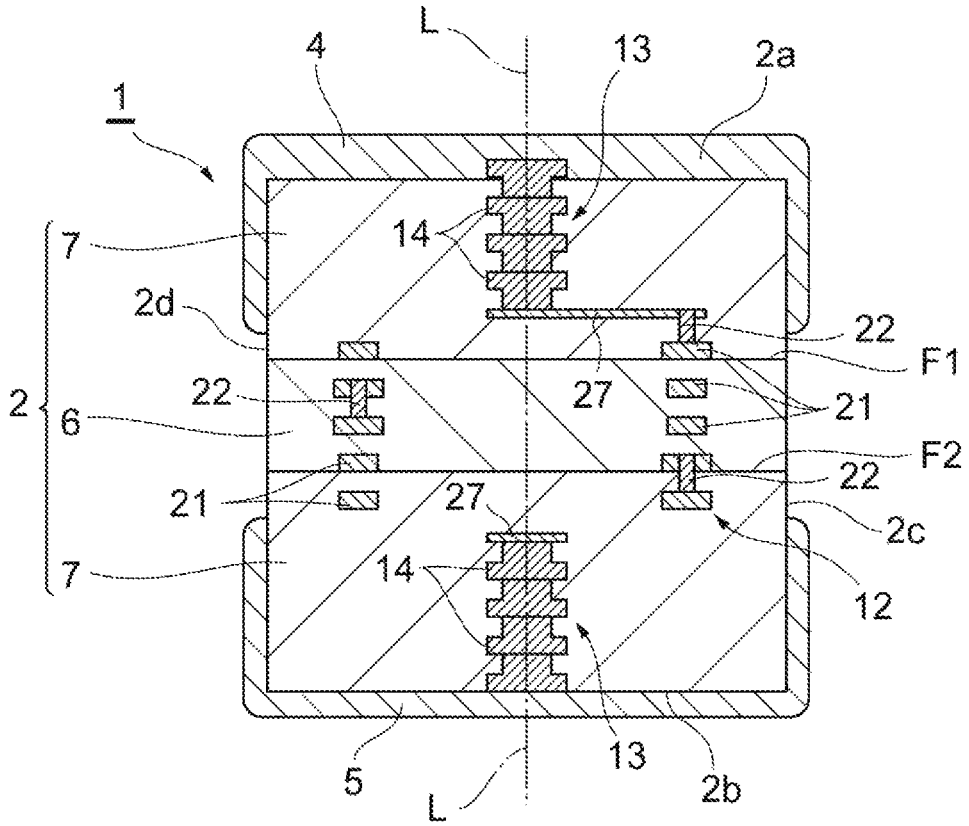
FIG. 2 is a cross-sectional view taken along line II-II of the multilayer coil component illustrated in FIG. 1.

As illustrated in FIGS. 1 and 2, a multilayer coil component 1 includes a ferrite element body 2 having a substantially rectangular parallelepiped shape and a multilayer coil C formed in the ferrite element body 2.

The ferrite element body 2 is formed of a ferrite element body material containing ferrite as a main component, and can be formed by calcining a laminate in which multilayered green sheets 11A and 11B to be described below are overlapped. Therefore, the ferrite element body 2 can be regarded as a laminate of ferrite layers and has a lamination direction. However, the ferrite layers constituting the ferrite element body 2 can be integrated to such an extent that boundaries therebetween cannot be visually recognized. The ferrite element body 2 has an outer shape of a substantially rectangular parallelepiped shape, and includes, as outer surfaces thereof, a pair of end surfaces 2*a* and 2*b* facing each other in the lamination direction and four side surfaces 2*c*, 2*d*, 2*e*, and 2*f* extending in a direction in which the pair of end surfaces 2*a* and 2*b* face each other to connect the pair of end surfaces 2*a* and 2*b*.

As illustrated in FIG. 2, the ferrite element body 2 includes a first element body portion 6 and a pair of second element body portions 7. More specifically, the ferrite element body 2 has a structure (sandwich structure) in which the first element body portion 6 is adjacent to the pair of second element body portions 7 to be sandwiched therebetween in a lamination direction of the ferrite element body 2.

In the present embodiment, both the first element body portion 6 and the second element body portion 7 are formed of a ferrite element body material containing a Ni—Cu—Zn-based ferrite as a main component, but contents of the constituent components therein are different from each other. Specifically, the ferrite element body material forming the first element body portion 6 contains a main component composed of 45.0 mol % of Fe compounds in terms of $Fe_2O_3$, 8.0 mol % of Cu compounds in terms of CuO, 8.0 mol % of Zn compounds in terms of ZnO, and the remainder being Ni compounds, and accessory components including 1.0 parts by weight of Si compounds in terms of $SiO_2$, 5.0 parts by weight of Co compounds in terms of $CO_3O_4$, and 0.8 parts by weight of Bi compounds in terms of $Bi_2O_3$ with respect to 100 parts by weight of the main component. Also, the ferrite element body material forming the second element body portion 7 contains a main component composed of 37.0 mol % of Fe compounds in terms of $Fe_2O_3$, 8.0 mol % of Cu compounds in terms of CuO, 34.0 mol % of Zn compounds in terms of ZnO, and the remainder being Ni compounds, and accessory components including 4.5 parts by weight of Si compounds in terms of $SiO_2$, 0.5 parts by weight of Co compounds in terms of $Co_3O_4$, and 0.8 parts by weight of Bi compounds in terms of $Bi_2O_3$ with respect to 100 parts by weight of the main component. That is, both the first element body portion 6 and the second element body portion 7 contain ZnO as a constituent component, and a ZnO content rate of the first element body portion 6 is lower than a ZnO content rate of the second element body portion 7. Further, both the first element body portion 6 and the second element body portion 7 contain NiO as a constituent component, and a NiO content rate of the first element body portion 6 is higher than a NiO content rate of the second element body portion 7.

Further, the ferrite element body material forming both the first element body portion 6 and the second element body portion 7 contains $Zn_2SiO_4$ as an accessory component. In the present embodiment, a $Zn_2SiO_4$ content rate of the first element body portion 6 is 1 part by weight with respect to 100 parts by weight of the ferrite element body material, and a $Zn_2SiO_4$ content rate of the second element body portion 7 is 17 parts by weight with respect to 100 parts by weight of the ferrite element body material. That is, the $Zn_2SiO_4$ content rate of the first element body portion 6 is lower than the $Zn_2SiO_4$ content rate of the second element body portion 7.

Further, a dielectric constant of the second element body portion 7 is lower than a dielectric constant of the first element body portion 6. In the present embodiment, a dielectric constant of the first element body portion 6 is about 14, and a dielectric constant of the second element body portion 7 is about 12. Also, a magnetic permeability of the second element body portion 7 is higher than a magnetic permeability of the first element body portion 6. In the present embodiment, a magnetic permeability of the first element body portion 6 is about 6, and a magnetic permeability of the second element body portion 7 is about 11.

The multilayer coil C is constituted by a plurality of conductive layers overlapping in the lamination direction of the ferrite element body 2 and has an axis L parallel to the lamination direction of the ferrite element body 2. The multilayer coil C includes a coil winding portion (winding portion) 12 and a pair of lead-out portions 13 extending from each end portion of the coil winding portion 12 to the end surfaces 2*a* and 2*b*. Each of the lead-out portions 13 includes a lead-out conductor 14 and a connection conductor 15. Each conductive layer constituting the multilayer coil C is configured to contain a conductive material such as Ag, Pd, or the like.

Also, the multilayer coil component 1 includes a pair of external electrodes 4 and 5 disposed on both end surfaces 2*a* and 2*b* of the ferrite element body 2, respectively. The external electrode 4 is formed to cover the whole of one end surface 2*a* and some of the four side surfaces 2*c*, 2*d*, 2*e*, and 2*f* and is electrically connected to the lead-out portion 13 extending to the end surface 2*a*. The external electrode 5 is formed to cover the whole of the other end surface 2*b* and some of the four side surfaces 2*c*, 2*d*, 2*e*, and 2*f* and is electrically connected to the lead-out portion 13 extending to the end surface 2*b*. The lamination direction of the ferrite element body 2 coincides with a direction in which the pair of end surfaces 2*a* and 2*b* face each other, and the pair of external electrodes 4 and 5 are respectively disposed at opposite end portions of the ferrite element body 2 in relation to the lamination direction. Further, the respective external electrodes 4 and 5 can be formed by causing the outer surfaces of the ferrite element body 2 to be coated with a conductive paste containing Ag, Pd, or the like as a main component, followed by baking and then electroplating them. For the electroplating, Ni, Sn, or the like can be used.

Figure 3:
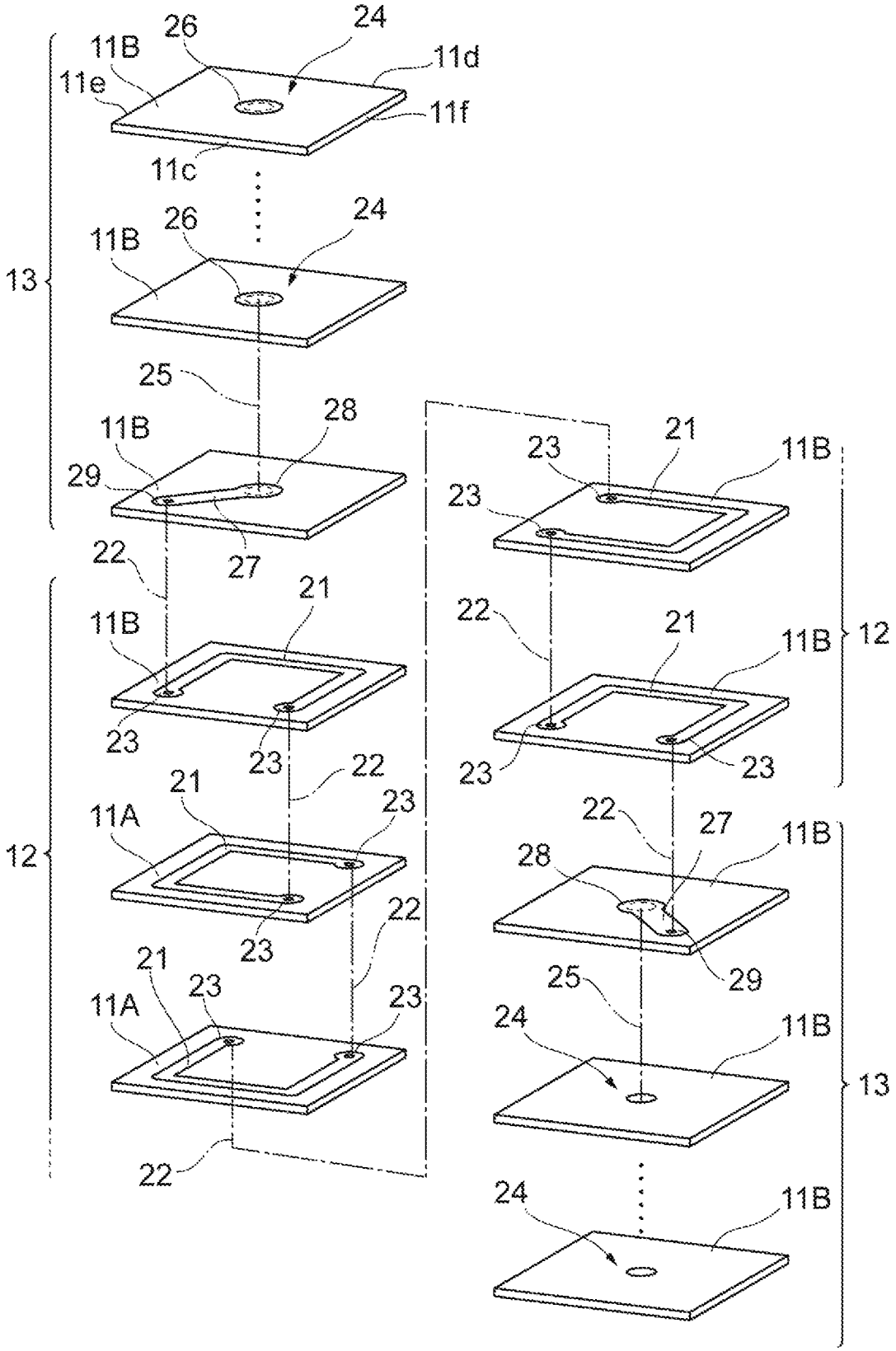
FIG. 3 is a perspective view illustrating a lamination state of green sheets when the multilayer coil component illustrated in FIG. 1 is manufactured.

As illustrated in FIG. 3, the multilayer coil component 1 described above can be formed by calcining a laminate in which multi-layered green sheets 11A and 11B are overlapped.

Each of the green sheets 11A and 11B has a rectangular shape (a square shape in the present embodiment), and includes four sides 11*c*, 11*d*, 11*e*, and 11*f* which define the side surfaces 2*c*, 2*d*, 2*e*, and 2*f* of the ferrite element body 2. The green sheet 11A is a green sheet to be the first element body portion 6 described above, and components thereof have been adjusted for a ferrite layer having a composition of the above-described first element body portion 6 after calcination. The green sheet 11B is a green sheet to be the second element body portion 7 described above, and components thereof have been adjusted for a ferrite layer having a composition of the above-described second element body portion 7 after calcination.

Respective green sheets 11A and 11B are arranged such that the green sheets 11B are used for a lower stage portion and an upper stage portion of a green sheet laminate and the green sheets 11A are used for an intermediate stage portion thereof to form a structure in which the first element body portion 6 is adjacent to the pair of second element body portions 7 to be sandwiched therebetween in the lamination direction.

In each of the green sheets 11A and 11B, a conductor pattern to be the above-described conductive layer is formed. Each conductor pattern can be formed by screen printing a conductive paste using screen plate making in which an opening corresponding to the pattern is formed.

Each conductor pattern 21 forming the coil winding portion 12 is formed in substantially a U shape. A substantially circular pad portion 23 corresponding to a through-hole conductor 22 is formed at each of one end portion and the other end portion of the conductor patterns 21. Each of the conductor patterns 21 is connected in series via the through-hole conductor 22 with each of the phases shifted by 90 degrees, and forms the coil C in which the axis L extends in the lamination direction. The conductor pattern 21 may be formed not only on the green sheet 11A in the intermediate stage portion of the green sheet laminate, but also on the green sheet 11B in the upper stage portion and the lower stage portion thereof.

A conductor pattern 24 forming the lead-out conductor 14 is formed as a substantially circular pad portion (pad conductor) 26 corresponding to a through-hole conductor 25. That is, the lead-out conductor 14 is constituted by the through-hole conductor 25 and a pad portions 26 provided integrally with the through-hole conductor 25. The pad portion 26 has a larger diameter than the pad portion 23 of the coil winding portion 12 and is disposed coaxially with the axis L of the coil C formed of the coil winding portion 12. Each conductor pattern 24 is connected in series via the through-hole conductor 25, and forms the lead-out conductor 14 extending along the axis L of the coil C. An outer end portion of each lead-out conductor 14 is exposed to each of the end surfaces 2*a* and 2*b* in the lamination direction of the ferrite element body 2, and is connected to each of the external electrodes 4 and 5. The conductor pattern 24 is formed on the green sheet 11B in the upper stage portion and the lower stage portion of the green sheet laminate.

A conductor pattern 27 forming the connection conductor 15 is linearly formed to connect a position corresponding to one pad portion 23 of the coil winding portion 12 and a position corresponding to the pad portion 26 of the lead-out conductor 14. A substantially circular pad portion 28 corresponding to the through-hole conductor 25 is formed to be coaxial with the pad portion 26 of the lead-out conductor 14 in substantially the same shape at one end portion of the conductor pattern 27, and a substantially circular pad portion 29 corresponding to the through-hole conductor 22 is formed to be coaxial with the pad portion 23 of the coil winding portion 12 in substantially the same shape at the other end portion of the conductor pattern 27. One end portion of the conductor pattern 27 is connected to the other end portion of the lead-out conductor 14 via the through-hole conductor 25, and the other end portion of the conductor pattern 27 is connected to an end portion of the coil winding portion 12 via the through-hole conductor 22. The conductor pattern 27 is formed on the green sheet 11B in the upper stage portion and the lower stage portion of the green sheet laminate.

As illustrated in FIG. 2, in the ferrite element body 2 described above, interfaces F1 and F2 between the first element body portion 6 and the second element body portions 7 pass through the coil winding portion 12 and extend perpendicular to the lamination direction. In other words, the coil winding portion 12 is provided to extend over the first element body portion 6 and the second element body portion 7 in the lamination direction. More specifically, the coil winding portion 12 is provided to extend from one second element body portion 7 (for example, an upper second element body portion in the cross-sectional view of FIG. 2) to the other second element body portion 7 (for example, a lower second element body portion in the cross-sectional view of FIG. 2) via the first element body portion 6 in the ferrite element body 2.

The interfaces F and F2 described above can be caused to appropriately slide by increasing or decreasing the number of green sheets 11A and 11B described above. Also, by sliding the interfaces F1 and F2, proportions of the first element body portion 6 and the second element body portion 7 in the ferrite element body 2 can also be appropriately changed.

The inventors have newly found that the first element body portion 6 and the second element body portion 7 contribute to respective coil characteristics of impedance, inductance, and a self-resonant frequency when the coil winding portion 12 is provided to extend over the first element body portion 6 and the second element body portion 7.

Regarding impedance around 1 GHz, the first element body portion 6 is relatively high and the second element body portion 7 is relatively low. Also, regarding inductance, the first element body portion 6 is relatively low and the second element body portion 7 is relatively high. Further, regarding a self-resonant frequency, the first element body portion 6 is relatively high and the second element body portion 7 is relatively low.

Therefore, in the multilayer coil component 1, desired coil characteristics can be obtained by adjusting proportions of the first element body portion 6 and the second element body portion 7 in the ferrite element body 2.

More specifically, when a dielectric constant of the ferrite element body 2 is reduced by adjusting proportions between the first element body portion 6 and the second element body portion 7, stray capacitance decreases and impedance around 1 GHz increases. Also, when a magnetic permeability of the ferrite element body 2 is reduced by adjusting proportions between the first element body portion 6 and the second element body portion 7, a self-resonant frequency increases, impedance also increases, and inductance decreases. Further, when a magnetic permeability of the ferrite element body 2 is increased by adjusting proportions between the first element body portion 6 and the second element body portion 7, a self-resonant frequency decreases, impedance also decreases, and inductance increases.

Also, in the multilayer coil component 1 described above, since the external electrodes 4 and 5 are respectively provided at the second element body portions 7 having a relatively low dielectric constant, a high frequency characteristic of the multilayer coil component 1 is improved.

The present invention is not limited to the above-described embodiment. For example, in the above-described embodiment, although a configuration in which the external electrodes 4 and 5 are respectively disposed on the end surfaces 2*a* and 2*b* of the element body and a so-called longitudinal winding coil in which an extending direction (axial direction) of the axis L of the multilayer coil C extends in the lamination direction of the ferrite element body 2 is connected to the external electrodes 4 and 5 has been described as an example, the coil may be a lateral winding coil, and arrangement positions of the external electrodes 4 and 5 are not particularly limited as long as they are on outer surfaces of the element body. That is, the external electrodes 4 and 5 are not necessarily provided on the end surfaces 2*a* and 2*b* facing each other in a direction of the axis L of the multilayer coil C, and may be provided on the side surfaces 2*c*, 2*d*, 2*e*, and 2*f*. In this case, a lead-out portion of the coil C extends from end portions of a winding portion to the side surfaces 2*c*, 2*d*, 2*e*, 2*f* on each of which an external electrode is provided.

What is claimed is:

1. A multilayer coil component comprising:

a ferrite element body;

a multilayer coil provided in the ferrite element body;

external electrodes respectively provided on end surfaces of the ferrite element body facing each other;

a first element body portion of the ferrite element body;

a second element body portion of the ferrite element body, the second element body portion being adjacent to the first element body portion in an axial direction of the multilayer coil, a dielectric constant of the second element body portion being lower than a dielectric constant of the first element body portion, and a magnetic permeability of the second element body portion being higher than a magnetic permeability of the first element body portion;

a winding portion of the multilayer coil, the winding portion extending over the first element body portion and the second element body portion; and a lead-out portion of the multilayer coil, the lead-out portion extending from end portions of the winding portion to the end surfaces provided with the external electrodes thereon.

2. The multilayer coil component according to claim 1, wherein the axial direction of the multilayer coil is parallel to a direction wherein the end surfaces face each other, the end surfaces being provided with the external electrodes.

3. The multilayer coil component according to claim 1, wherein there is a plurality of one of the first element body portion and the second element body portion, the ferrite element body has a structure wherein the one of the first element body portions and the second element body portions sandwich the other thereof in the axial direction of the multilayer coil.

4. The multilayer coil component according to claim 3, wherein the ferrite element body includes a pair of second element body portions and has a structure wherein the first element body portion is sandwiched by the pair of second element body portions in the axial direction of the multilayer coil.

5. The multilayer coil component according to claim 2, wherein there is a plurality of one of the first element body portion and the second element body portion, the ferrite element body has a structure wherein the one of the first element body portions and the second element body portions sandwich the other thereof in the axial direction of the multilayer coil.

6. The multilayer coil component according to claim 5, wherein the ferrite element body includes a pair of second element body portions and has a structure wherein the first element body portion is sandwiched by the pair of second element body portions in the axial direction of the multilayer coil.

* * * * *